US007173589B2

(12) United States Patent
Senda et al.

(10) Patent No.: US 7,173,589 B2
(45) Date of Patent: Feb. 6, 2007

(54) DISPLAY DEVICE

(75) Inventors: Michiru Senda, Gifu (JP); Ryoichi Yokoyama, Ogaki (JP)

(73) Assignee: Sanyo Electric Co., Ltd., Osaka (JP)

( * ) Notice: Subject to any disclaimer, the term of this patent is extended or adjusted under 35 U.S.C. 154(b) by 611 days.

(21) Appl. No.: 10/106,859

(22) Filed: Mar. 27, 2002

(65) Prior Publication Data

US 2002/0153843 A1 Oct. 24, 2002

(30) Foreign Application Priority Data

Mar. 29, 2001 (JP) ..... 2001-095258
Mar. 29, 2001 (JP) ..... 2001-095259

(51) Int. Cl.
*G09G 3/36* (2006.01)

(52) U.S. Cl. ..... 345/90; 345/92; 345/98; 345/204

(58) Field of Classification Search ..... 345/87–103, 345/1.1, 76–83, 204; 315/169.3; 365/155
See application file for complete search history.

(56) References Cited

U.S. PATENT DOCUMENTS 5,471,225 A 11/1995 Parks
5,673,230 A * 9/1997 Kuriyama ..... 365/203
5,712,652 A * 1/1998 Sato et al. ..... 345/90
5,790,090 A 8/1998 Libsch et al.
5,945,972 A 8/1999 Okumura et al.
5,952,991 A 9/1999 Akiyama
5,977,940 A 11/1999 Akiyama et al.
6,023,308 A 2/2000 Takemura
6,072,454 A 6/2000 Nakai et al.
6,181,608 B1 * 1/2001 Keshavarzi et al. ..... 365/188
6,531,893 B2 * 3/2003 Matsumoto ..... 326/68
6,664,943 B1 * 12/2003 Nakajima et al. ..... 345/98

FOREIGN PATENT DOCUMENTS

EP 0 797 182 9/1997
EP 1 020 840 7/2000
EP 1111577 A 6/2001
EP 1189194 A 3/2002
JP 58-23091 2/1983
JP 08-194205 * 7/1996
JP 09-236823 9/1997
JP 2001-242819 9/2001

OTHER PUBLICATIONS

Optimizing MOS Transistor Mismatch Simon J. Lovett et al 1998 IEEE.*
Study on Hydrogenation of Polysilicon Thin Film Transistor by Ion Implanation Min Cao et al 1995 IEEE.*
European Search Report dated Aug. 16, 2005, directed to EP Application No. 02007529.7.

* cited by examiner

*Primary Examiner*—Lun-Yi Lao
(74) *Attorney, Agent, or Firm*—Morrison & Foerster LLP

(57) ABSTRACT

A digital image signal fed from the drain signal line is written into a retaining circuit through a pixel element selection TFT and a liquid crystal displays an image based on the digital image signal. In the retaining circuit, a threshold voltage of the first inverter circuit is set smaller than a threshold voltage of the second inverter circuit. Therefore, false writing of the image signal data into the retaining circuit can be prevented, leading to an accurate display the image signal retained in the retaining circuit.

16 Claims, 7 Drawing Sheets

DISPLAY DEVICE

BACKGROUND OF THE INVENTION

1. Technical Field of the Invention

This invention relates to a display device, specifically to a display device which is incorporated into a portable communication and computing device.

2. Background of the Invention

There has been a great demand in the market for portable communication and computing devices such as a portable TV and a cellular phone. All these devices need a small, light-weight and low-power consumption display device, and efforts have been made accordingly.

FIG. 6 shows a circuit diagram corresponding to a single pixel element of a conventional liquid crystal display device. A gate signal line 51 and a drain signal line 61 are placed on an insulating substrate (not shown) perpendicular to each other. A thin-film transistor (TFT) 65 connected to two signal lines 51, 61, is formed near the intersection of the two signal lines 51, 61. A source 11*s* of the TFT 65 is connected to a display electrode 80 of a liquid crystal 21.

A storage capacitor element 85 holds the voltage of the display electrode 80 during one field period. One terminal 86 of the storage capacitor 85 is connected to the source 11*s* of the TFT 65 and the other terminal 87 is provided with a voltage common among all the pixel elements. When a scanning signal is applied to the gate signal line 51, the TFT 65 turns to an on-state. Accordingly, an analog image signal from the drain signal line 61 is applied to the display electrode 80, and the storage capacitor 85 holds the voltage. The voltage of the image signal is applied to the liquid crystal 21 through the display electrode 80, and the liquid crystal 21 aligns in response to the applied voltage for providing a liquid crystal display image. This configuration is capable of showing both moving images and still images. There is a need for the display to show both a moving image and a still image within a single display. One such example is to show a still image of a battery within an area of a moving image of a cellular phone display to show the remaining amount of the battery power.

However, the configuration shown in FIG. 6 requires a continuous rewriting of each pixel element with the same image signal at each scanning in order to provide a still image. This is basically to show a still-like image in a moving image mode, and the scanning signal needs to activate the TFT 65 at each scanning. Accordingly, it is necessary to operate a driver circuit which generates a driver signal for the scanning signals and the image signals, and an external LSI which generates various signals for controlling the timing of the driver circuit, resulting in a significant electric power consumption. This is a considerable drawback when such a configuration is used in a cellular phone device which has only a limited power source. That is, the time a user can use the telephone under one battery charge is considerably decreased.

Japanese Laid-Open Patent Publication No. Hei 8-194205 discloses another configuration for a display device suitable for portable applications. This display device has a static memory for each of the pixel elements, as shown in FIG. 7. A static memory, in which two inverters INV1 and INV2 are positively fed back to each other, holds the image signal. This results in reduced power consumption. In this configuration, a switching element 24 controls the resistance between a reference line and a display electrode 80 in response to the divalent digital image signal held by the static memory in order to adjust the biasing of the liquid crystal 21. The common electrode, on the other hand, receives an AC signal Vcom. Ideally, this configuration does not need to refresh the memory when the image stays still for a period of time.

As described above, the display device equipped with a retaining circuit (a static memory) for holding digital image signals is suitable for displaying a still image with a shallow depth and reducing the consumption of the electric power.

However, the aforementioned liquid crystal display device has the following problem. The problem will be explained hereinafter by referring to FIG. 8. Suppose a "L (low)" level is held at a source 11*s* of a pixel element selection TFT 72, and a "H (high)" level is held at the output node of an inverter INV1.

Under this condition, when the external circuit outputs "H" to the drain signal line 61 to write "H" into the static memory, the N channel TFT of an inverter INV2 is on. Thus, as shown by the broken line in FIG. 8*a*, the electric current from the drain signal line 61 goes through the pixel element selection TFT 72 and reaches the N channel TFT. Therefore, the "H" level competes against "L" level, resulting in a reduced "H" level, and possibly causing a false writing. In order to achieve the correct writing of the "H" data, the voltage of the source 11*s* of the pixel element selection TFT 72 should be higher than the threshold voltage of the inverter INV1. However, because of the presence of the electric passage described above, this condition may not be fulfilled due to the decrease in the voltage of the source 11*s* of the pixel element selection TFT 72.

The similar problem takes place when the "L" level is held at the output node of the INV1 (see FIG. 8*b*). Under this condition, when the external circuit outputs the "L" to the drain signal line 61 to write the "L" into the static memory, the P channel TFT of the inverter INV2 is on. Thus, as shown by the broken line in FIG. 8*b*, the electric current goes through the P channel TFT and then to the pixel element selection TFT 72 to reach the drain signal line 61. In order to achieve the correct writing of "L" data, the voltage of the source 11*s* of the pixel element selection TFT 72 should be lower than the threshold voltage of the inverter INV1. However, because of the presence of the electric passage described above, the condition mentioned above may not be fulfilled due to the increase of the voltage of the source 11*s* of the pixel element selection TFT 72.

Accordingly, a conventional device such as shown in FIG. 8 may not properly change the status of the retaining circuit, or may take a long time to change the status.

SUMMARY OF THE INVENTION

This invention is directed to the smooth writing of data into the retaining circuit which retains the image signal data.

The invention provides a display device including a plurality of gate signal lines disposed in a first direction, a plurality of drain signal lines disposed in a second direction different from the first direction, a pixel element selection transistor selecting a display pixel element in response to a scanning signal fed from the gate signal line, and a retaining circuit disposed in the display pixel element. The retaining circuit holds an image signal fed from the drain signal line through the pixel element selection transistor, and the image signal retained in the retaining circuit is used to form an image. The retaining circuit includes a first inverter circuit receiving the image signal from the drain signal line and a second inverter circuit positively feeding back an output of the first inverter circuit into an input of the first inverter circuit. The threshold voltage of first inverter circuit is smaller than the threshold voltage of the second inverter circuit.

In this configuration, since the threshold voltage of the first inverter is lower than the threshold voltage of the second inverter, the retaining loop of the retaining circuit forms immediately after receiving the signal, enabling high speed and accurate writing of the image signal data.

This display device may have the following features:

(A) The first and second inverter circuits are CMOS inverter circuits. A channel-length (L) to channel-width (W) ratio, which is calculated by dividing L by W (L/W), of the P channel transistor of the first inverter circuit is larger than the ratio of the P channel transistor of the second inverter circuit. This ratio will be referred to as a L/W ratio hereinafter.

(B) The first and second inverter circuits are CMOS inverter circuits. The L/W ratio of the N channel transistor of the first inverter circuit is smaller than the L/W ratio of the N channel transistor of the second inverter circuit.

The invention also provides a display device including a plurality of gate signal lines disposed in a first direction, a plurality of drain signal lines disposed in a second direction different from the first direction, a pixel element selection transistor selecting a display pixel element in response to a scanning signal fed from the gate signal line, and a retaining circuit disposed in the display pixel element. The retaining circuit holds an image signal fed from the drain signal line through the pixel element selection transistor, and the image signal retained in the retaining circuit is used for forming an image. The retaining circuit of this device includes a first inverter circuit receiving the image signal from the drain signal line and a second inverter circuit positively feeding back an output of the first inverter circuit into an input of the first inverter circuit. The output resistance of the second inverter circuit is larger than an on-state resistance of the pixel element selection transistor.

In this embodiment, the output on-state resistance of the second inverter circuit is set larger than the on-state resistance of the pixel element selection transistor. Therefore, the influence of the output condition of the second inverter circuit on the change in the source voltage of the pixel element selection transistor based on the image signal fed from the drain signal line (the input voltage of the first inverter circuit) can be minimized. This prevents false writing of data into the retaining circuit.

This display may have the following features:

(A) The first and second inverter circuits are CMOS inverter circuits. The on-state resistance of the N channel transistor of the second inverter circuit is larger than the on-state resistance of the pixel element selection transistor. When the "H" level is held at the output node of the first inverter circuit and the "H" level image signal is inputted from the drain signal line, the electric current goes from the drain signal line to the N channel transistor of the second inverter circuit. Since the on-state resistance is so that the input voltage of the first inverter circuit is higher than its threshold voltage, the image signal is written and retained correctly.

(B) The L/W ratio of the N channel transistor is larger than the L/W ratio of the pixel element selection transistor. According to this configuration, the on-state resistance can be accurately set based on the ratio of the transistor's size.

(C) The first and second inverter circuits are CMOS inverter circuits. The on-state resistance of the P channel transistor of the second inverter circuit is larger than the on-state resistance of the pixel element selection transistor. When the "L" level is held at the output node of the first inverter circuit and the "L" level image signal is inputted from the drain signal line, the electric current goes from the P channel transistor of the second inverter circuit to the drain signal line. In this configuration, since the on-state resistance is so that the input voltage of the first inverter circuit is higher than its threshold voltage, the image signal is written and retained correctly.

(D) The L/W ratio of the P channel transistor is larger than the L/W ratio of the pixel element selection transistor. According to this configuration, the on-state resistance can be accurately set based on the ratio of the transistor's size.

DETAILED DESCRIPTION OF THE INVENTION

Figure 1:
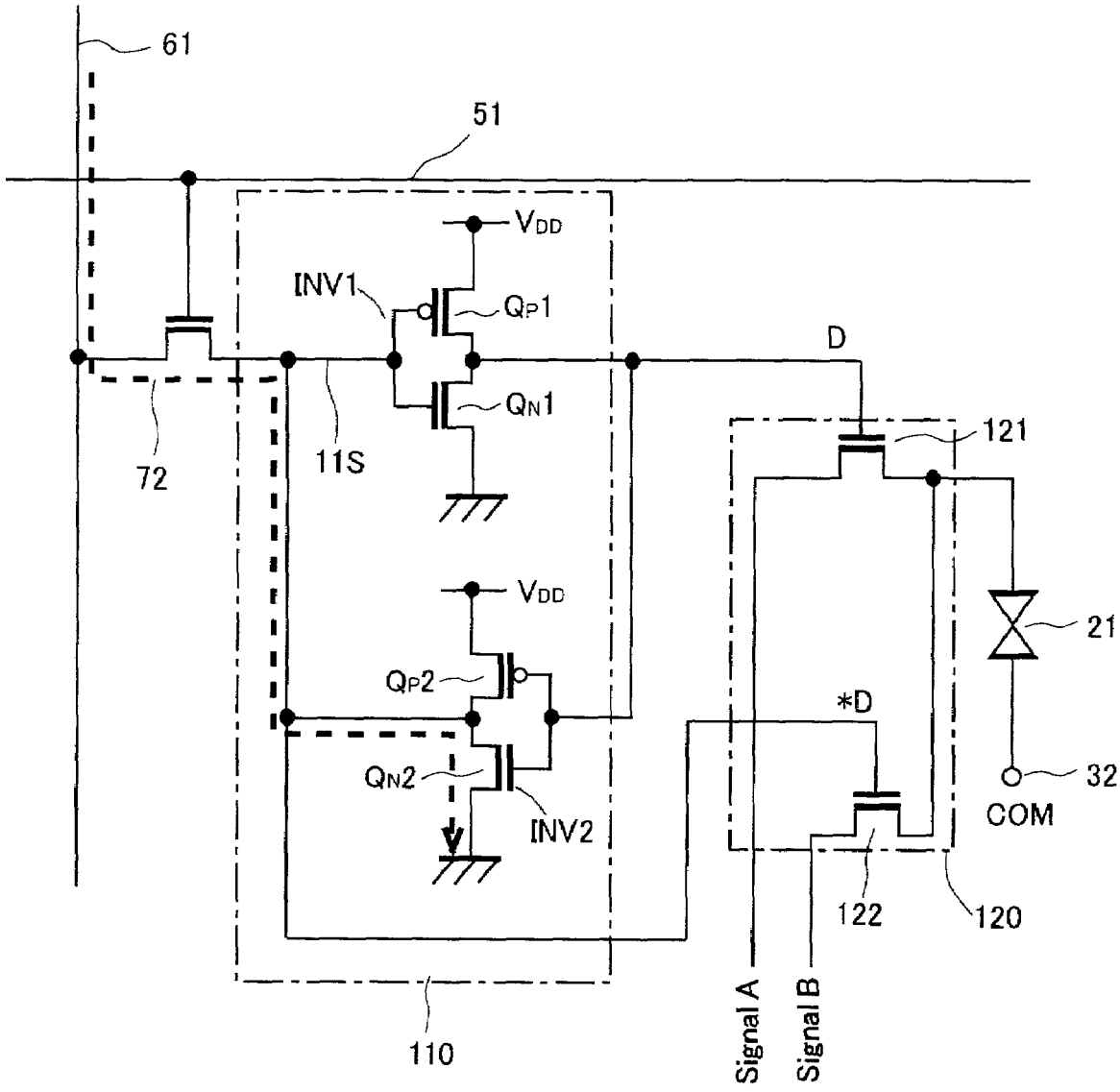
FIG. 1 is a circuit diagram showing one display pixel element of the liquid crystal display device of the first embodiment of this invention.

The display device of a first embodiment of this invention will be explained by referring to the circuit diagram shown in FIG. 1. This embodiment describes a case where this invention is applied to the liquid crystal display device.

On an insulating substrate (not shown in the figure), a gate signal line 51 and a drain signal line 61 are formed perpendicular to each other. Near the crossing of the signal lines, a pixel element selection TFT 72, connected to the both of the signal lines 51, 61, is also formed.

A retaining circuit 110 comprises first and second inverter circuits that form a positive feed back loop. A source 11*s* of the pixel element selection TFT 72 is connected to the input terminal of the first inverter circuit INV1 and its output is fed to the second inverter circuit INV2. The output of the second inverter circuit INV2 is connected to the input terminal of the first inverter circuit INV1.

The first inverter circuit INV1 is a CMOS type inverter circuit and comprises a P channel TFT QP1 and an N channel TFT QN1, which are connected in series between the source voltage VDD and the earth voltage VSS. Likewise, the second inverter circuit is a CMOS type inverter and comprises a P channel TFT QP2 and an N channel TFT QN2, which are connected in series between the source voltage VDD and the earth voltage VSS.

In this embodiment, the following configurations are applied for smoothly writing the digital image signal into the retaining circuit 110.

As the first configuration of this invention, the threshold voltage VT1 of the first inverter circuit INV1 is set lower than the threshold voltage VT2 of the inverter circuit INV2. This means that the L/W ratio, or the channel-length to channel-width ratio, which is calculated by dividing L by W (L/W), of the P channel TFT QP1 of the first inverter circuit INV1 is larger than the L/W ratio of the P channel TFT QP2 of the second inverter circuit INV2. For example, L/W=12 μm/2 μm in TFT QP1, and L/W=10 μm/2 μm in TFT QP2. Also, the L/W ratio of the N channel TFT QN1 of the first inverter circuit INV1 (for example, L/W=10 μm/2 μm) is smaller than the L/W ratio of the N channel TFT QN2 of the second inverter circuit INV2 (for example, L/W=12 μm/2 μm).

When the "H" level is held at the output node of the first inverter circuit INV1 and written into the retaining circuit 110 from drain signal line 61, the "H" level competes against the "L" level, as described earlier, lowering the input voltage of the first inverter circuit INV1. However, in this configuration, the threshold voltage VT1 of the first inverter circuit INV1 is lower than VT2 of the second inverter circuit. Therefore the requirement that the input voltage should be higher than the VT1 can be easily fulfilled.

The output of the first inverter circuit INV1 inverts smoothly from "H" to "L". Also, when the output of the first inverter circuit INV1 inverts from "H" to "L", the output of the second inverter circuit INV2 inverts smoothly from "L" to "H". This is because the threshold voltage TV2 of the second inverter circuit INV2 is set relatively high. In this manner, a new retaining loop of the retaining circuit 110 forms immediately in response to the signal. This leads to high speed and accurate writing of the image signal data.

If the pixel element selection TFT 72 is an N channel TFT, a voltage equal to the threshold voltage Vtn of the pixel element selection TFT 72 is lost when the "H" digital image signal is fed from the drain signal line 61. This makes accurate writing difficult. However, the configuration described above is especially effective to solve this problem. Also, when the "L" level is held at the output node of the first inverter circuit and the "L" is written into the retaining circuit 110 from the drain signal line 61, there is no voltage loss. Therefore, the low threshold voltage VT1 of the first inverter circuit INV1 does not cause any problems.

As the second configuration of this invention, the output resistance of the second inverter circuit INV2 is set lager than the on-state resistance of the pixel element selection TFT 72. As described later, the first inverter circuit INV1 is constructed so that the first inverter circuit can perform the inverting operation based on the image signal data fed from the drain signal line 61.

The on-state resistance of the N channel TFT QN2 of the second inverter circuit INV2 is larger than the on-state resistance of the pixel element selection TFT 72. In order to set the on-state resistance in this manner, the L/W ratio of the N channel TFT QN2 should be larger than the L/W ratio of the pixel element selection TFT 72.

When the "H" level is held at the output node of the first inverter circuit INV1 and the "H" level digital image signal is inputted from drain signal line 61, electric current goes from the drain signal line 61 to N channel TFT QN2. In this configuration, the on-state resistance is set so that the voltage of the source 11*s* of the pixel element selection TFT, which is the input voltage of the first inverter circuit INV1, is higher than the threshold voltage of the first inverter circuit INV1. Therefore, the digital image signal can be accurately written and retained.

Likewise, the on-state resistance of the P channel TFT QP2 of the second inverter circuit INV2 is larger than the on-state resistance of the pixel element selection TFT 72. In order to set the on-state resistance in this manner, the L/W ratio of the P channel TFT QP2 should be larger than the L/W ratio of the pixel element selection TFT 72.

When the "L" level is held at the output node of the first inverter circuit INV1 and the "L" level digital image signal is inputted from drain signal line 61, electric current goes from the P channel TFT QP2 to the drain signal line 61. In this configuration, the on-state resistance is so that the voltage of the source 11*s* of the pixel element selection TFT, which is the input voltage of the first inverter circuit INV1, is lower than the threshold voltage of the first inverter circuit INV1. Therefore, the digital image signal can be accurately written and retained.

The digital image signal with two values retained in the retaining circuit 110 is applied to the gates of the signal selection TFTs 121 and 122 of the signal selection circuit 120 as complimentary output signals D and *D. The signal selection circuit 120 selects either signal A or signal B based on the output signal D or *D, and feeds the selected signal to the pixel element electrode of the liquid crystal 21. The signal selection TFT 121 and 122 are N channel TFTs.

Next, the operation of the device described above will be explained. The scanning signal G fed from the gate signal line 51 becomes "H", turning the pixel element selection TFT 72 on. Then, the digital image signal from the drain signal line 61 is written into the retaining circuit 110 through the pixel element selection TFT 72. Here, even if the two levels compete against each other, false writing is prevented because of the configurations described above.

Figure 2:
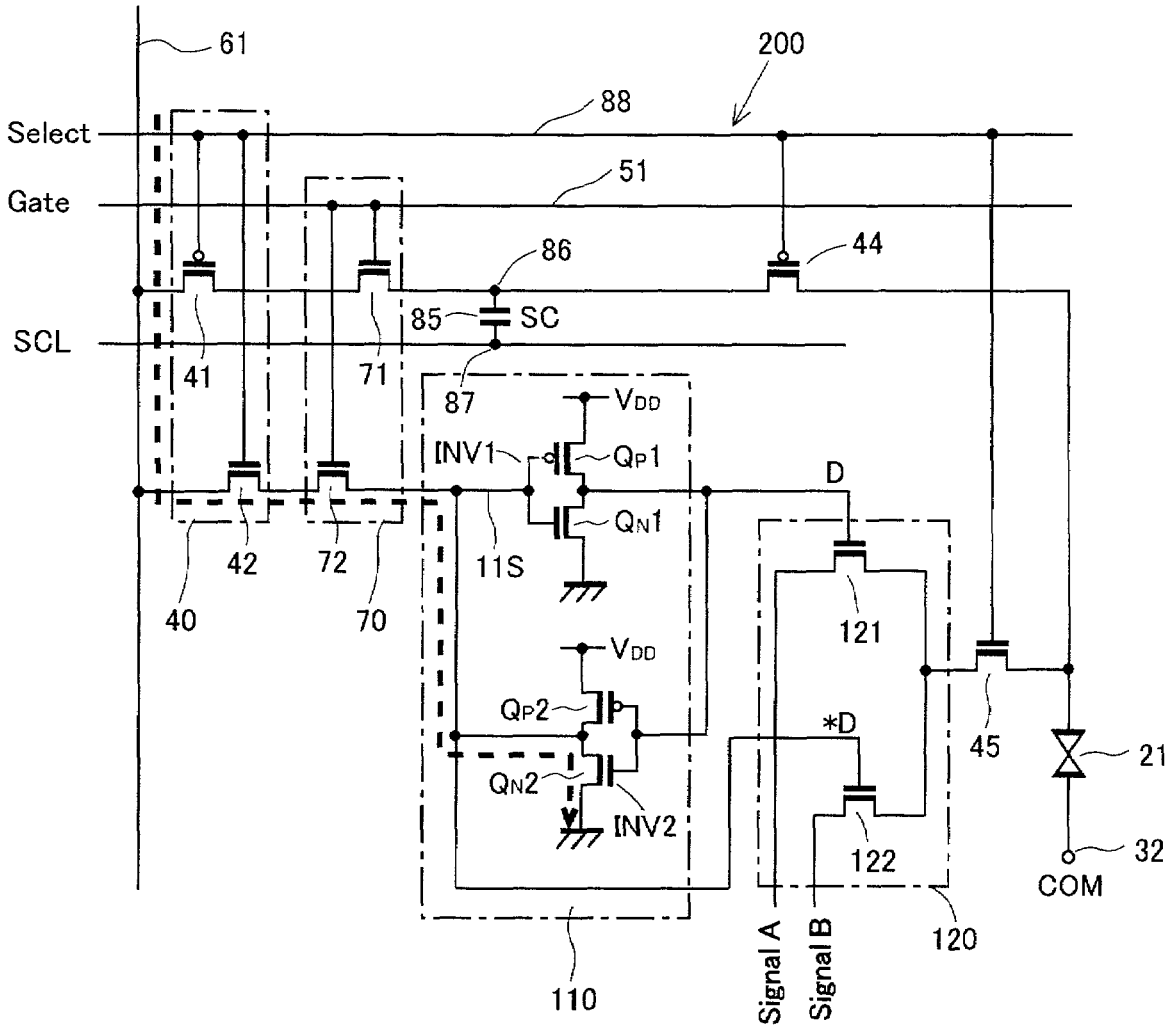
FIG. 2 is a circuit diagram showing one display pixel element of the liquid crystal display device of the second embodiment of this invention.
Figure 3:
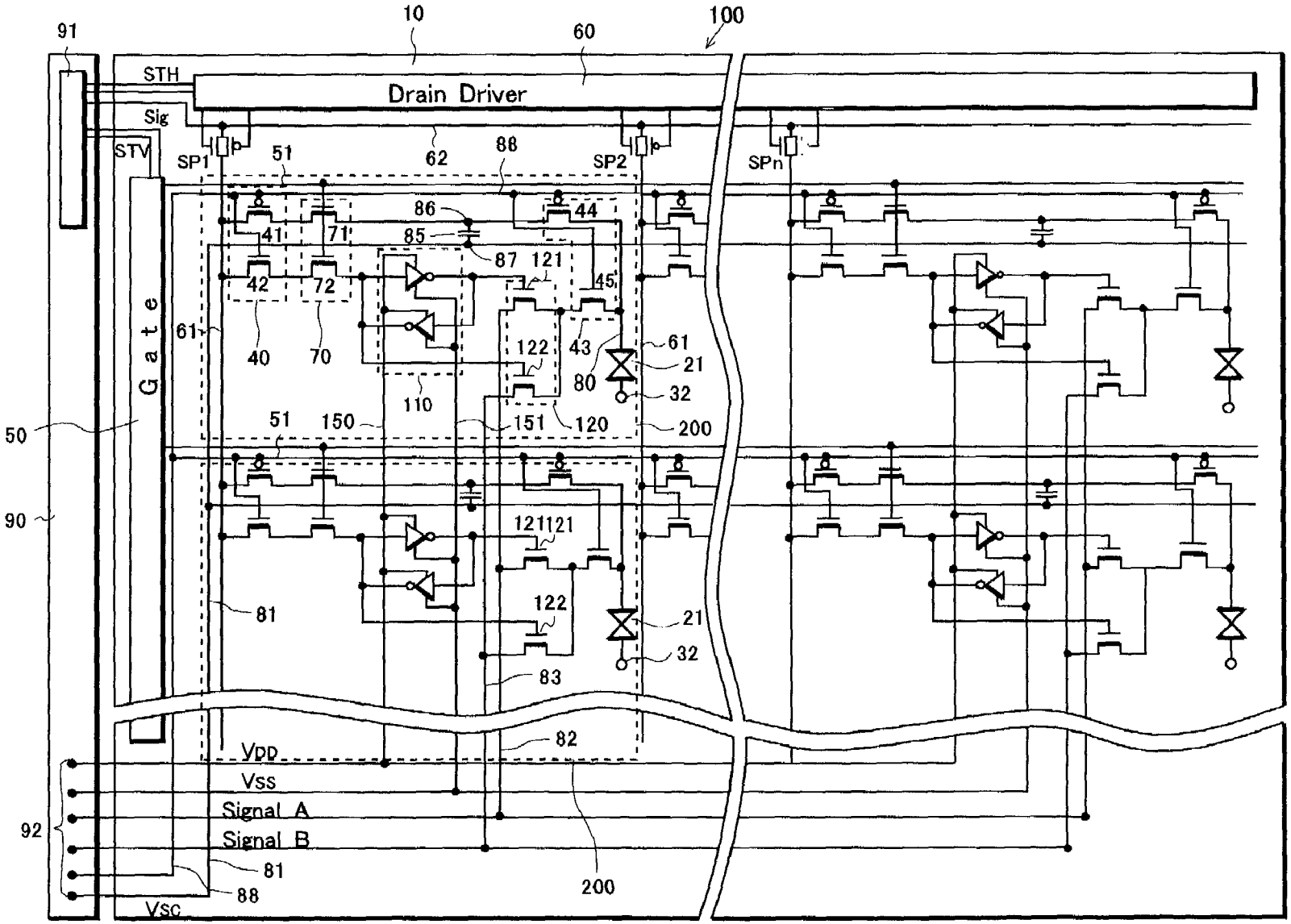
FIG. 3 is a circuit diagram of the whole display device in which the display pixel element of the second embodiment of this invention is employed.

Next, the second embodiment of this invention will be explained by referring to FIGS. 2 and 3. This embodiment also describes a case where this invention is applied to a liquid crystal display device. FIG. 2 is a circuit diagram showing the configuration of one pixel element 200. FIG. 3 is a circuit diagram of the whole display device including the pixel element 200. This display device is a liquid crystal display device capable of selecting between an analog display mode based on the analog image signal (full color moving picture) and a digital display mode based on the digital image signal retained in the retaining circuit 110 (still image).

On the insulating substrate 10 (not shown in the figure), a plurality of gate signal lines 51 connected to the gate driver 50, which supplies the scanning signal, are disposed in one direction. A plurality of drain signal lines 61 are also disposed in a direction perpendicular to the gate signal line 51.

Sampling transistors SP1, SP2, . . . , SPn turn on in response to the timing of the sampling pulse fed from the drain driver 60. The data signal (which is the digital image signal or the analog image signal) of the data signal line 62 is fed to the drain signal line 61.

The liquid crystal display panel 100 consists of a plurality of pixel elements 200 provided in a matrix configuration. These pixels elements 200 are selected by the scanning signal fed from the gate signal line 51 and they receive the data signal fed from the drain signal line 61.

The detailed configuration of the pixel element 200 will be explained hereinafter. Near the crossing of the gate signal line 51 and drain signal line 61, the circuit selection circuit 40, comprising the P channel TFT 41 and the N channel TFT 42, is formed. Both drains of the TFTs 41 and 42 are connected to the drain signal line 61 and both gates of these TFTs are connected to the circuit selection circuit 88. Either one of TFTs 41 or 42 turns on based on the selection signal from the circuit selection signal line 88. Also, as explained later, the circuit selection circuit 43 is formed, and pairs with the circuit selection circuit 40.

Therefore, selecting as well as changing between the analog display mode (full color moving image) and the digital display mode (low power consumption, still image) is possible. Also, the pixel element selection circuit 70 having an N channel TFT 71 and an N channel TFT 72 is formed adjacent to the circuit selection circuit 40. The pixel element selection TFTs 71 and 72 are connected to the circuit selection TFTs 41 and 42 of the circuit selection circuit 40 in the vertical direction, respectively. Also, both gates of the TFTs 71, 72 are connected to the gate signal lines 51. Both of the TFTs 71 and 72 turn on simultaneously in response to the scanning signal fed from the gate signal line 51.

A storage capacitance element 85 holds the analog image signal in the analog mode. One of the electrodes 86 of the storage capacitance element 85 is connected to the source 71*s* of the TFT 71. Another electrode 87 is connected to a common storage capacitance line SCL carrying a bias voltage Vsc. When the analog image signal is applied to the liquid crystal 21 after the TFT gates of the circuit selection circuit 70 open, the voltage of the applied signal reduces even during one field period. This results in a loss of the homogeneity of the display image. The storage capacitance element 85 maintains the applied voltage at its initial level during one field period for eliminating the problem discussed above.

A P channel TFT 44 of the circuit selection circuit 43 is placed between the storage capacitance element 85 and the liquid crystal 21, and turns on and off in synchronization with the switching of the TFT 41 of the circuit selection circuit 40. A retaining circuit 110 and a signal selection circuit 120 are placed between the TFT 72 of the pixel element selection circuit 70 and the pixel element electrode 80 of the liquid crystal 21.

As shown in FIG. 2, the retaining circuit 110 has two inverter circuits, the first and second inverter circuits, which are positively fed back to each other. The source 11*s* of the pixel element selection TFT 72 is connected to the input terminal of the first inverter circuit INV1, and its output is inputted to the second inverter circuit INV2. Also, the output terminal of the second inverter circuit INV2 is connected to the input terminal of the first inverter circuit INV1.

Under the digital display mode, when the voltage of the circuit selection signal line 88 becomes "H", and when the scanning signal of the gate signal line 51 also becomes "H", it is possible to write into the retaining circuit 110.

In order to make the writing of the digital image signal into the retaining circuit 110 smooth, the configuration described below, which is similar to the first embodiment, is adopted. That is, as in the first configuration, the threshold voltage VT1 of the first inverter circuit INV1 is smaller than the threshold voltage of the second inverter circuit INV2. The detailed explanation on the configuration is omitted, as it is the same as the first embodiment.

As the second configuration, the output resistance of the second inverter circuit INV2 is larger than the sum of the on-state resistance of the pixel element selection TFT 72 and that of the circuit selection transistor 42. Therefore, as described later, the first inverter circuit INV1 can perform the inverting operation based on the digital image signal from the drain signal line 61.

The on-state resistance of the N channel TFT QN2 of the second inverter circuit INV2 is larger than the sum of the on-state resistance of the pixel element selection TFT 72 and that of the circuit selection transistor 42. In order to have this characteristic, the L/W ratio of the N channel TFT QN2 should be larger than the sum of the L/W ratio of the pixel element selection TFT 72 and the L/W ratio of the circuit selection TFT 42.

When the "H" level is held at the output node of the first inverter circuit and the "H" level digital image signal is inputted from the drain signal line, electric current goes from the drain signal line 61 to the N channel TFT QN2 through the pixel element selection TFT 72 and the circuit selection TFT 42. In this configuration, since the on-state resistance is set so that the input voltage of the first inverter circuit INV1 is higher than the threshold voltage of the first inverter circuit INV1, the digital image signal can be accurately written and retained.

Likewise, the on-state resistance of the P channel TFT QP2 of the second inverter circuit INV2 is set larger than the sum of the on-state resistance of the pixel element selection TFT 72 and that of the circuit selection transistor 42. In order to have this characteristic, the L/W ratio of the P channel TFT QP2 should be larger than the sum of the L/W ratio of the pixel element selection TFT 72 and the L/W ratio of the circuit selection TFT 42.

When the "L" level is held at the output node of the first inverter circuit and when the "L" level digital image signal is inputted from the drain signal line, electric current goes from the P channel TFT QP2 of the second inverter circuit INV2 to the drain signal line 61 through the pixel element selection TFT 72 and the circuit selection circuit TFT 42. In this configuration, since the on-state resistance is set so that the input voltage of the first inverter circuit INV1 is lower than the threshold voltage of the first inverter circuit INV1, the digital image signal can be accurately written and retained.

The signal selection circuit 120 has two N channel TFTs 121, 122 and selects a signal in response to the signal fed from the retaining circuit 110. Since two complementary output signals from the retaining circuit 110 are applied to the gates of the two TFTs 121, 122, respectively, only one of the two TFTs 121, 122 turns on at a time.

Here, the AC drive signal (signal B) is selected when the TFT 122 turns on, and the common electrode signal Vcom (signal A) is selected when the TFT 121 turns on. The selected signal is then applied to the pixel element electrode 80 of the liquid crystal 21 through the TFT 45 of the circuit selection circuit 43.

The liquid crystal panel 100 has peripheral circuit as well. An LSI 91 for driver scanning is mounted on an external circuit board 90 which is externally connected to the insulating substrate 10 of the liquid crystal panel 100, and sends the vertical start signal STV and the horizontal start signal STH to the gate driver 50 and the drain driver 60, respectively. The panel driver LSI also feeds the image signal to the data line 62.

Figure 4:
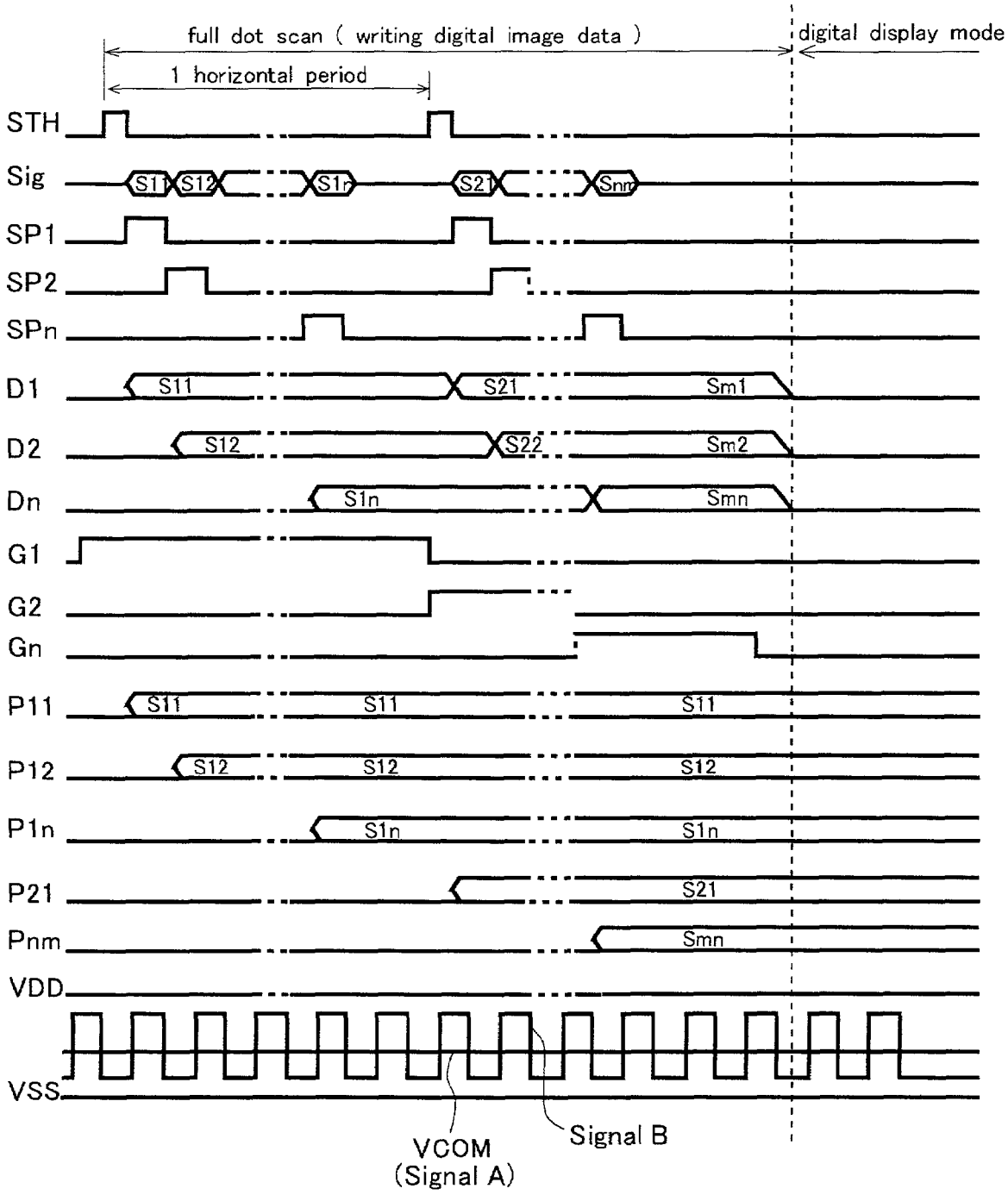
FIG. 4 is a timing chart showing the liquid crystal display device under the digital display mode of the first and second embodiments.

The driving method of the display device described above will be explained hereinafter in reference to FIGS. 2–4. FIG. 4 shows a timing chart when the liquid crystal display device is set to operate under the digital display mode.

(1) Analog Display Mode.

When the analog display mode is selected in response to the mode selection signal MD, the analog image signal is outputted to the data signal line 62. Also, the voltage applied to the circuit selection signal line 88 changes to "L" so that the TFTs 41, 44 of the circuit selection circuit 40, 43 turn on.

The sampling transistor SP turns on in response to the sampling signal based on the horizontal start signal STH so that the analog image signal is provided to the drain signal line 61 through the data signal line 62.

Also, the scanning signal is provided to the gate signal line 51 in accordance with the vertical start signal STV. When the TFT 71 turns on in response to the scanning signal, the analog image signal Sig is applied through the drain signal line 61 to the pixel element electrode 80 and the storage capacitance element 85, which holds the applied voltage. The liquid crystal 21 aligns itself in accordance with the image signal voltage applied to the liquid crystal 21 fed from the pixel element electrode 80, resulting in a display image.

The analog display mode is suitable for showing a full color moving picture. However, the external LSI 91 for driver scanning on the external circuit board 90 and the drivers 50, 60 continuously consume electric power for driving the liquid crystal display device.

(2) Digital Display Mode

When the digital display mode is selected in response to the mode selection signal MD, the data signal line 62 is set to receive the digital image signal. At the same time, the voltage of the circuit selection signal line 88 turns to "H", and the retaining circuit 110 is set to be operable. Further, the TFTs 41, 44 of the circuit selection circuit 40, 43 turn off and the TFTs 42, 45 of the circuit turn on.

The LSI 91 for driver scanning on the external circuit board 90 sends start signals STV, STH to the gate driver 50 and the drain driver 60, respectively. In response to the start signals, the sampling signals are sequentially generated and turn on the respective sampling transistors SP1, SP2, . . . , SPn sequentially, which sample the digital image signal Sig and send the signal Sig to each of the drain signal lines 61.

The operation of the first row of the matrix, or the operation of the gate signal line 51, which receives the scanning signal G1, will be described below. First, the scanning signal G1 turns on each TFT of the pixel elements, P11, P12 . . . , P1*n* connected to the gate signal line 51 for one horizontal field period.

In the pixel element P11 located at the upper left corner of the matrix, the sampling signal SP1 takes in the digital image signal S11 and feeds it to the drain signal line 61. The scanning signal GI becomes "H", turning the TFT 72 on. Thus, the drain signal D1 is written into the retaining circuit 110.

During the rewriting of the data, the two levels compete against each other. However, the configuration described above can prevent false writing of data.

The signal retained by the retaining circuit 110 is then fed to the signal selection circuit 120, and is used by the signal selection circuit 120 to select one of the signal A and signal B. The selected signal is then applied to the liquid crystal 21 through the pixel element electrode 80. Thus, upon a completion of a scanning from the first gate signal line 51, on the top row of the matrix, to the last gate signal line 51, on the bottom row of the matrix, a full display frame scan (one field scan) is completed.

Then, the display, in accordance with the data that is held in the retaining circuit 110 (still picture display), appears. Under this digital display mode, the supply of power voltage to the circuits such as the gate driver 50, the drain driver 60 and the external LSI 91 for driver scanning is halted. In the meantime, the retaining circuit 110 continuously receives the voltages VDD, VSS. Also, the common electrode 32 receives the common electrode voltage and the signal selection circuit 120 receives signal A and signal B.

That is, when the retaining circuit 110 receives VDD, VSS for its operation and, when the common electrode voltage VCOM (signal A) is applied to the common electrode, the liquid crystal display panel 100 is in the normally-white (NW) mode. In this mode, the same voltage as the common electrode 32 is applied to signal A and the AC drive voltage (for example 60 HZ) for driving the liquid crystal is applied to the signal B. Thereby, the data for one still picture is retained and displayed. Other circuits such as the gate driver 50, the drain driver 60 and the external LSI 91 for driver scanning do not receive any voltage.

When the retaining circuit 110 receives the digital image signal of "H" through the drain signal line 61, the first TFT 121 of the signal selection circuit 120 receives an "L" signal and, accordingly, turns off. The second TFT 122 receives an "H" signal and turns on.

In this case, the signal B is selected and the liquid crystal 21 receives the signal B, which has a phase opposite to that of signal A applied to the common electrode 32. This results in the rearrangement of the liquid crystal 21. Since the display panel is in an NW mode, a black image results.

When the retaining circuit 110 receives the digital image signal of "L" through the drain signal line 61, the first TFT 121 of the signal selection circuit 120 receives an "H" signal and, accordingly, turns on. The second TFT 122 receives an "L" signal and turns off. In this case, the signal A is selected and the liquid crystal 21 receives the signal A, which is the same as the signal A applied to the common electrode 32. As a result, there is no change in the arrangement of the liquid crystal 21 and the pixel stays white.

In this digital mode, the signals corresponding to one field are written in the retaining circuit 110, and a still image is displayed based on the signals retained in the retaining circuit 110. In this case, the drive of the driver circuits 50, 60 and the external LSI 91 for driver scanning is halted, resulting in a significant reduction of power consumption.

As described above, according to the embodiment of this invention, a single liquid crystal display panel provides two different display modes, full color moving image (analog display mode) and a digital depth display (digital display mode). Also, a false operation of the retaining circuit 110 can be prevented during writing.

In the above embodiment, the display device capable of switching between the analog display mode and the digital display mode is explained. However, this invention is broadly applicable to a display device having the retaining circuit 110 for retaining the digital image signal and making the image display based on the retained signal in the retaining circuit 110.

It is especially preferable that the display device of this invention be applied to a reflective liquid crystal display device. The structure of a reflective liquid crystal display device will be described below in reference to FIG. 5.

Figure 5:
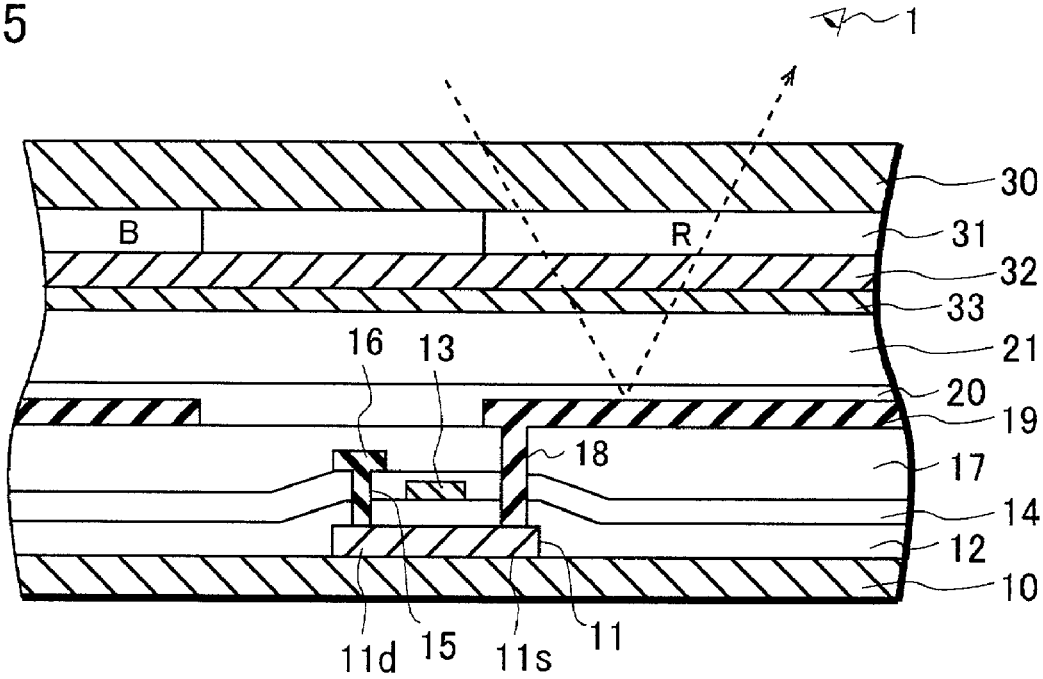
FIG. 5 is a cross-sectional view of the reflective liquid crystal display device.
Figure 6:
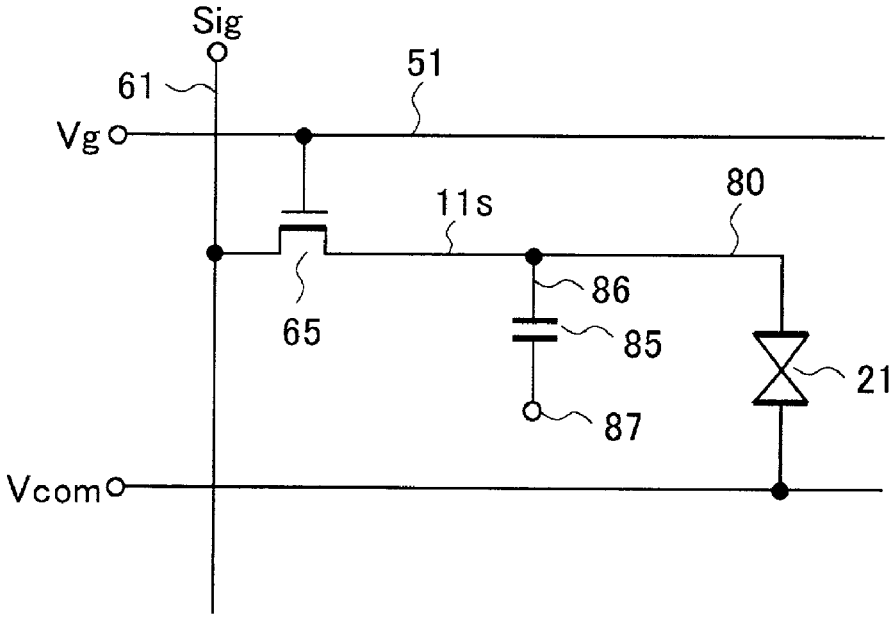
Fig.6 PRIOR ART
FIG. 6 is a circuit diagram of the conventional liquid crystal display device.
Figure 7:
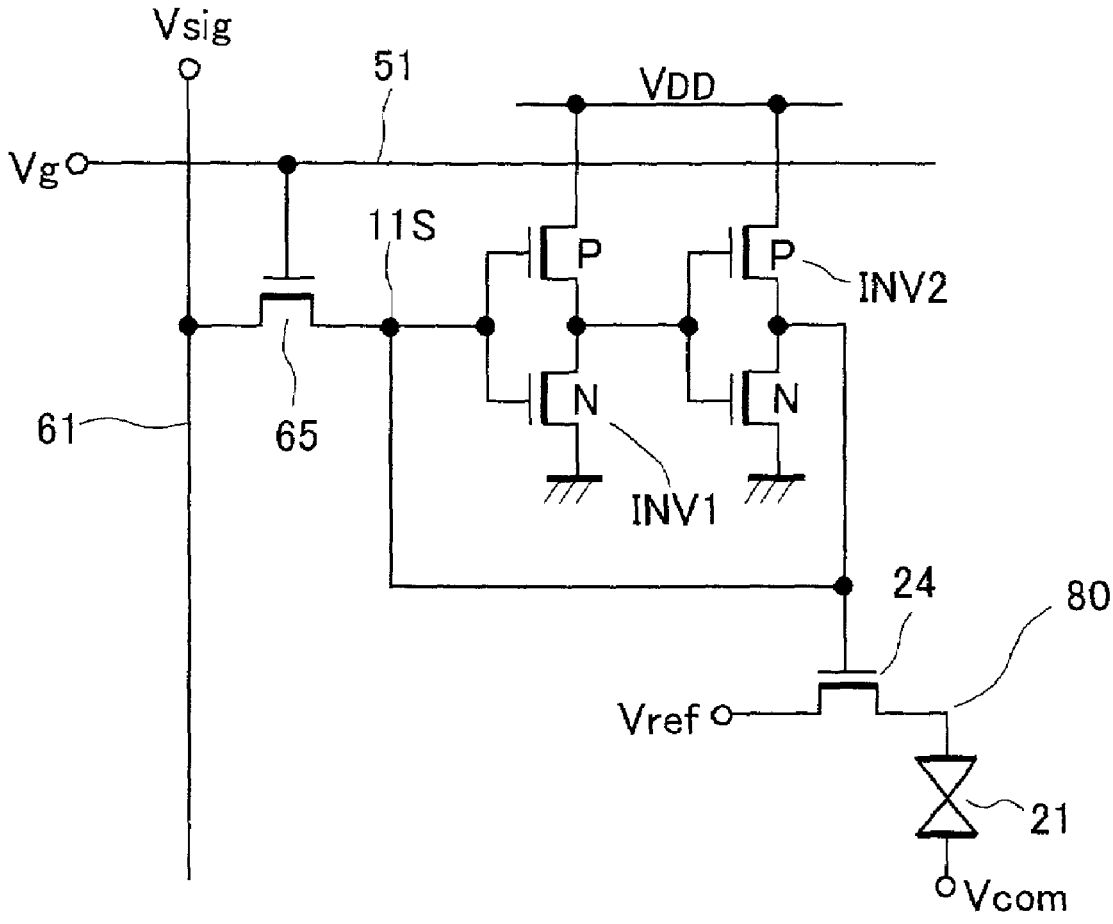
Fig.7 PRIOR ART
FIG. 7 is another circuit diagram of the conventional liquid crystal display device.
Figure 8:
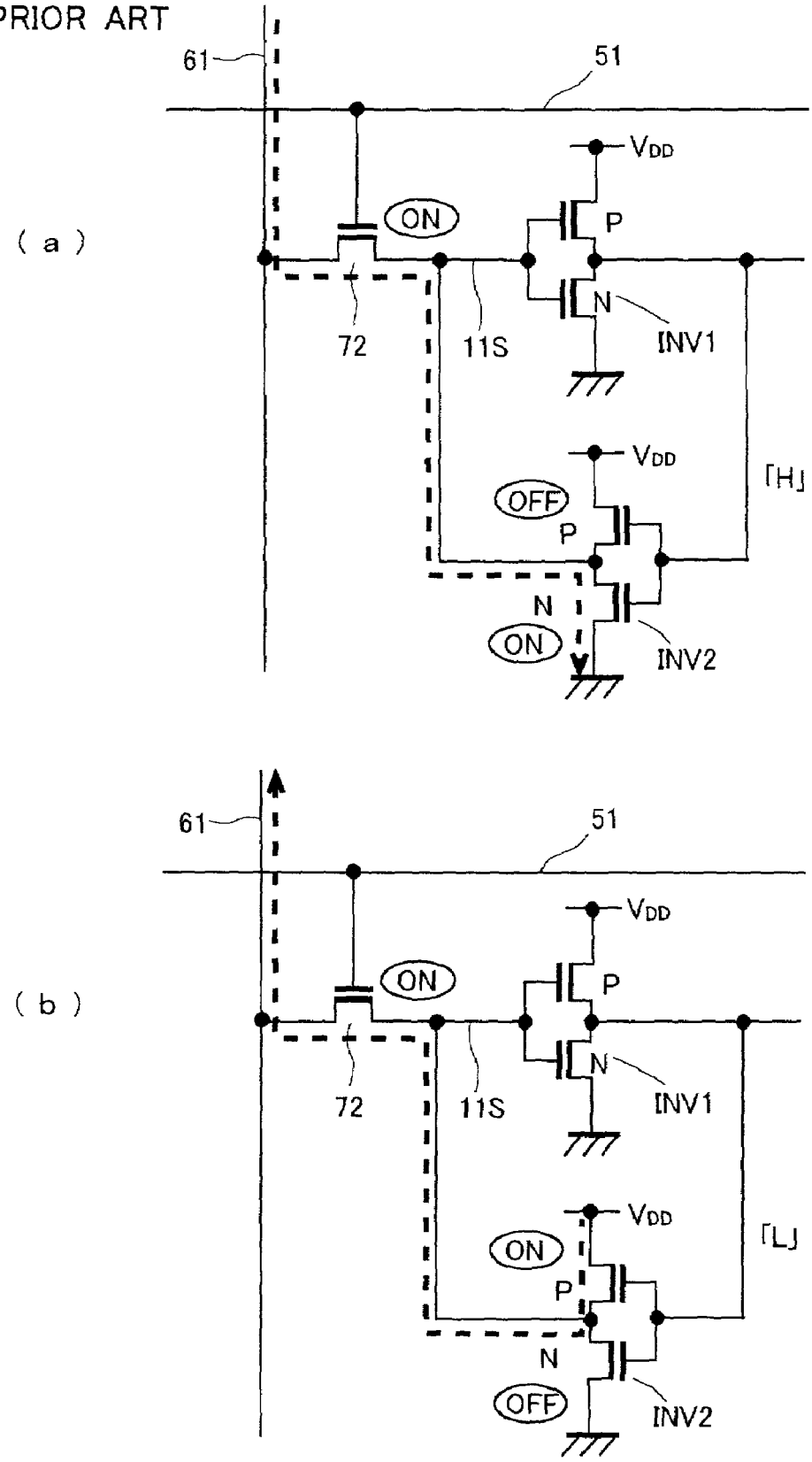
Fig.8 PRIOR ART
FIG. 8 is a circuit diagram depicting the problem of the conventional liquid crystal display device.

As shown in the FIG. 5, on one side of the insulating substrate 10, a gate insulating film 12 is formed on an isolated polysilicon semiconductor layer 11, and a gate electrode 13 is placed on the portion of the insulating film 12 corresponding to the polysilicon semiconductor layer 11.

A source 11*s* and a drain 11*d* are formed in the semiconductor layer 11 at the portions located at both sides of the gate electrode 13. An interlayer insulating film 14 is disposed above the gate electrode 13 and the gate insulating layer 12. Contact holes 15 are formed at the portions of the interlayer insulating film 14 corresponding to the drain 11*d* and the source 11*s*. The drain 11*d* is connected to a drain electrode 16 through the contact hole 15, and the source 11*s* is connected to a display electrode 19 through the contact hole 15, piercing through the interlayer insulating film 14 and a flattening insulating film 17 formed on the interlayer insulating film 14.

The display electrode 19 is placed on the flattening insulating film 17 and is made of a reflecting electrode material, for example, aluminum (Al). An orientation film 20 is placed on the display electrode 19 and the portions of the flattening insulating film 17. The orientation film 20 is made of polyimid and aligns the liquid crystal 21.

The insulating substrate 30 on the other side of the display device has color filters 31 for generating red (R), green (G), and blue (B) colors, a common electrode 32 made of a transparent electrode material such as ITO (indium tin oxide), and an orientation film 33 for aligning liquid crystal 21. When the display device does not make a color display, the color filter is not necessary.

In the gap between the two insulating substrates 10 and 30, which are attached together by sealing their peripheral portions with a sealing adhesive, the liquid crystal 21 is filled. This forms a reflective liquid crystal display device.

As shown in the figure, the light coming from an observer 1 side through the common electrode 32 and the incident on the display electrode 19 are reflected by the display electrode 19 so that the observer 1 recognizes the light modulated by the liquid crystal 21 of the display device.

In this manner, the reflective liquid crystal display device utilized the lights external to the device and does not need an internal light source, such as a back light in the transmitting-type liquid crystal display device. Thus, there is no need to supply electric power for the back light. Therefore, it is preferable to apply the display device of the invention to the reflective liquid crystal display device, which does not need the back light. This further reduces power consumption.

In the embodiment described above, the voltage to the common electrode and signals A and B are applied to the respective terminals throughout one full dot scan period of a field. This invention is not limited to that embodiment, and includes a configuration in which those voltages are not applied throughout the scan. Such a configuration is preferable because of a further reduction in power consumption by the display device.

Also, in the above embodiment, a one-bit digital data signal is used in the digital display mode. This invention is not limited to that embodiment, and is also applicable to a multiple-bit data signal system.

In such a configuration, multiple level image representation is possible. Also, it is necessary to provide the retaining circuits and the signal selection circuits in accordance with the number of bits used in the system.

In the above embodiment, only a portion of the liquid crystal display panel is used for displaying the still image. However, this invention is not limited to that embodiment. The still image may be displayed in the entire area of the display panel, in which case this invention is especially effective.

Also in the embodiment described above, the reflective liquid crystal display device is used. This invention is not limited to that embodiments, and may be applied to both the transmitting-type liquid crystal display device and the reflective-type liquid crystal display device. In that case, the display electrode is made of a transparent electrode material, rather than a reflecting electrode material. The display electrode is in the area of the pixel element other than the portions corresponding to the TFTs, the retaining circuit, the signal selection circuit and the signal wiring. When this invention is applied to the transmitting-type liquid crystal display device, it is also possible to reduce power consumption by halting supply of the voltage to the gate driver 50, the drain driver 60, and the external LSI 91 for driver scan after displaying one image.

In the display device of this invention, the threshold voltage of the first inverter circuit of the retaining circuit is smaller than the threshold voltage of the second inverter circuit. Therefore, the image signal from the drain signal line is smoothly written through the pixel element selection transistor.

Therefore, even if the power voltage supplied to the display device is low, the false writing of the image signal or a decrease in the writing speed can be prevented. As a result, the reduction of the voltage in the display device is possible. This leads to a display device with low power consumption.

In the display device of this invention, the output resistance of the second inverter of the retaining circuit, which retains the image signal fed from the drain signal line, is larger than the on-state resistance of the pixel element selection transistor. Such a configuration prevents the output of the second inverter circuit from affecting the change in the input voltage of the first inverter circuit based on the image signal. Therefore, false writing into the retaining circuit is prevented, leading to an accurate display based on the image signal retained in the retaining circuit.

Also in the display device of the low power consumption, which is capable of switching between an analog display mode and a digital display mode, the output resistance of the second inverter of the retaining circuit is larger than the sum of the on-state resistance of the pixel element selection transistor and that of the circuit selection transistor. Therefore, under the digital display mode, false writing into the retaining circuit is prevented. This leads to an accurate display based on the image signal retained in the retaining circuit.

The above is a detailed description of the particular embodiments of the invention which are not intended to limit the invention to the embodiments described. It is recognized that modifications within the scope of the invention will occur to a person skilled in the art. Such modifications and equivalents of the invention are intended for inclusion within the scope of this invention.

What is claimed is:

1. A display device comprising:

a plurality of gate signal lines disposed in a first direction;

a plurality of drain signal lines disposed in a second direction different from the first direction;

a pixel element selection transistor selecting a display pixel element in response to a scanning signal fed from one of the gate signal lines; and a retaining circuit disposed in the display pixel element, the retaining circuit holding an image signal fed from one of the drain signal lines through the pixel element selection transistor, the image signal retained in the retaining circuit being used for forming an image; and a signal selection circuit that receives the image signal held by the retaining circuit, receives more than one voltage, selects one of the voltages corresponding to the received image signal and applies the selected voltage to a pixel element electrode of the display pixel element, wherein the retaining circuit comprises a first inverter circuit receiving the image signal from one of the drain signal lines and a second inverter circuit positively feeding back an output of the first inverter circuit into an input of the first inverter circuit, and a threshold voltage of the first inverter circuit is smaller than a threshold voltage of the second inverter circuit.

2. The display device of claim 1, wherein the first inverter circuit and the second inverter circuit comprise CMOS inverter circuits, and a channel-length to channel-width ratio of a P channel transistor of the first inverter circuit is larger than a channel-length to channel-width ratio of a P channel transistor of the second inverter circuit.

3. The display device of claim 2, wherein a channel-length to channel-width ratio of an N channel transistor of the first inverter circuit is smaller than a channel-length to channel-width ratio of an N channel transistor of the second inverter circuit.

4. The display device of claim 3, wherein the pixel element selection transistor is an N channel transistor.

5. A display device, comprising:

a plurality of gate signal lines disposed in a first direction;

a plurality of drain signal lines disposed in a second direction different from the first direction;

a pixel element selection transistor selecting a display pixel element in response to a scanning signal fed from one of the gate signal lines;

a pixel element electrode disposed in the display pixel element;

a first display circuit disposed in the display pixel element supplying an image signal fed from one of the drain signal lines to the pixel element electrode, the first display circuit operating in an analog mode;

a second display circuit disposed in the display pixel element, the second display circuit having a retaining circuit which holds the image signal fed from one of the drain signal lines through the pixel element selection transistor, and supplying a voltage signal corresponding to the image signal retained in the retaining circuit to the pixel element electrode, the second display circuit operating in a digital mode; and a circuit selection transistor connected in series to the pixel element selection transistor, the circuit selection transistor selecting the first or the second display circuit; and wherein the retaining circuit comprises a first inverter circuit receiving the image signal from one of the drain signal lines and a second inverter circuit positively feeding back an output of the first inverter circuit into an input of the first inverter circuit, and a threshold voltage of the first inverter circuit is smaller than a threshold voltage of the second inverter circuit.

6. The display device of claim 5, wherein the first inverter circuit and the second inverter circuit comprise CMOS inverter circuits, and a channel-length to channel-width ratio of a P channel transistor of the first inverter circuit is larger than a channel-length to channel-width ratio of a P channel transistor of the second inverter circuit.

7. The display device of claim 6, wherein a channel-length to channel-width ratio of an N channel transistor of the first inverter circuit is smaller than a channel-length to channel-width ratio of an N channel transistor of the second inverter circuit.

8. A display device comprising:

a plurality of gate signal lines disposed in a first direction;

a plurality of drain signal lines disposed in a second direction different from the first direction;

a pixel element selection transistor selecting a display pixel element in response to a scanning signal fed from one of the gate signal lines;

a retaining circuit disposed in the display pixel element, the retaining circuit holding an image signal fed from one of the drain signal lines through the pixel element selection transistor, the image signal retained in the retaining circuit being used for forming an image; and a signal selection circuit that receives the image signal held by the retaining circuit, receives more than one voltage, selects one of the voltages corresponding to the received image signal and applies the selected voltage to a pixel element electrode of the display pixel element, wherein the retaining circuit comprises a first inverter circuit receiving the image signal from one of the drain signal lines and a second inverter circuit positively feeding back an output of the first inverter circuit into an input of the first inverter circuit, and an output resistance of the second inverter circuit is larger than an on-state resistance of the pixel element selection transistor.

9. The display device of claim 8, wherein the first inverter circuit and the second inverter circuit comprise CMOS inverter circuits, and an on-state resistance of a P channel transistor of the second inverter circuit is larger than an on-state resistance of the pixel element selection transistor.

10. The display device of claim 8, wherein the first inverter circuit and the second inverter circuit comprise CMOS inverter circuits and an on-state resistance of an N channel transistor of the second inverter circuit is larger than an on-state resistance of the pixel element selection transistor.

11. The display device of claim 10, wherein a channel-length to channel-width ratio of the N channel transistor is larger than a channel-length to channel-width ratio of the pixel element selection transistor.

12. The display device of claim 10, wherein a channel-length to channel-width ratio of the P channel transistor is larger than a channel-length to channel-width ratio of the pixel element selection transistor.

13. A display device comprising:

a plurality of gate signal lines disposed in a first direction;

a plurality of drain signal lines disposed in a second direction different from the first direction;

a pixel element selection transistor selecting a display pixel element in response to a scanning signal fed from one of the gate signal lines;

a pixel element electrode disposed in the display pixel element;

a first display circuit disposed in the display pixel element supplying an image signal fed from one of the drain signal lines to the pixel element electrode, the first display circuit operating in a first mode;

a second display circuit disposed in the display pixel element, the second display circuit having a retaining circuit which holds the image signal fed from one of the drain signal lines through the pixel element selection transistor, and supplying a voltage signal corresponding to the image signal retained in the retaining circuit to the pixel element electrode, the second display circuit operating in a second mode; and a circuit selection transistor connected in series to the pixel element selection transistor, the circuit selection transistor selecting the first or the second display circuit, wherein the retaining circuit comprises a first inverter circuit receiving the image signal from one of the drain signal lines and a second inverter circuit positively feeding back an output of the first inverter circuit into an input of the first inverter circuit, and an output resistance of the second inverter circuit is larger than an on-state resistance of the pixel element selection transistor, and the first inverter circuit and the second inverter circuit comprise CMOS inverter circuits, and an on-state resistance of an N channel transistor of the second inverter circuit is larger than a summation of an on-state resistance of the pixel element selection transistor and an on-state resistance of the circuit selection transistor.

14. The display device of claim 13, wherein a channel-length to channel-width ratio of an N channel transistor is larger than a summation of a channel-length to channel-width ratio of the pixel element selection transistor and a channel-length to channel-width ratio of the circuit selection circuit.

15. A display device comprising:

a plurality of gate signal lines disposed in a first direction;

a plurality of drain signal lines disposed in a second direction different from the first direction;

a pixel element selection transistor selecting a display pixel element in response to a scanning signal fed from one of the gate signal lines;

a pixel element electrode disposed in the display pixel element;

a first display circuit disposed in the display pixel element supplying an image signal fed from one of the drain signal lines to the pixel element electrode, the first display circuit operating in a first mode;

a second display circuit disposed in the display pixel element, the second display circuit having a retaining circuit which holds the image signal fed from one of the drain signal lines through the pixel element selection transistor, and supplying a voltage signal corresponding to the image signal retained in the retaining circuit to the pixel element electrode, the second display circuit operating in a second mode; and a circuit selection transistor connected in series to the pixel element selection transistor, the circuit selection transistor selecting the first or the second display circuit, wherein the retaining circuit comprises a first inverter circuit receiving the image signal from one of the drain signal lines and a second inverter circuit positively feeding back an output of the first inverter circuit into an input of the first inverter circuit, and an output resistance of the second inverter circuit is larger than an on-state resistance of the pixel element selection transistor, and the first inverter circuit and the second inverter circuit comprise CMOS inverter circuits, and an on-state resistance of a P channel transistor of the second inverter circuit is larger than a summation of an on-state resistance of the pixel element selection transistor and an on-state resistance of the circuit selection circuit.

16. The display device of claim 15, wherein a channel-length to channel-width ratio of a P channel transistor is larger than a summation of a channel-length to channel-width ratio of the pixel element selection transistor and a channel-length to channel-width ratio of the circuit selection circuit.

* * * * *